US011315005B1

(12) United States Patent
Habash

(10) Patent No.: US 11,315,005 B1
(45) Date of Patent: Apr. 26, 2022

(54) FINGER-MOUNTED MECHANICAL COUNTER

(71) Applicant: GIFTEDNESS AND CREATIVITY COMPANY, Safat (KW)

(72) Inventor: Abduljalil K. H. Habash, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/373,529

(22) Filed: Jul. 12, 2021

Related U.S. Application Data

(60) Provisional application No. 63/121,922, filed on Dec. 6, 2020.

(51) Int. Cl.

| | |
|---|---|
| ***G06M 1/02*** | (2006.01) |
| ***G06M 1/14*** | (2006.01) |
| ***A44C 9/00*** | (2006.01) |
| ***G06M 1/04*** | (2006.01) |
| ***G06M 1/24*** | (2006.01) |

(52) U.S. Cl.
CPC ..... *G06M 1/041* (2013.01); *A44C 9/0053* (2013.01); *G06M 1/02* (2013.01); *G06M 1/143* (2013.01); *G06M 1/24* (2013.01)

(58) Field of Classification Search
CPC ..... G06M 1/041; G06M 1/02; G06M 1/143; G06M 1/24; G06M 1/248; A44C 9/0053; A44C 9/00
USPC ..... 62/1.12, 15
See application file for complete search history.

(56) References Cited

U.S. PATENT DOCUMENTS 2,004,881 A 6/1935 Slye
2,310,114 A * 2/1943 Poole ..... G06M 1/041 235/131 R
2,331,884 A * 10/1943 Bliss ..... G06M 1/143 235/131 FD (Continued)

FOREIGN PATENT DOCUMENTS

CH 479919 A * 10/1969 ..... G06M 1/283
CN 107229963 10/2017

(Continued)

OTHER PUBLICATIONS

"Hand Tally Counter"; printed on Jun. 4, 2021 from https://tallycounterstore.com/hand-tally-counter-quantity-discounts/.

(Continued)

*Primary Examiner* — Jack W Lavinder
(74) *Attorney, Agent, or Firm* — Nath, Goldberg & Meyer; Richard C. Litman

(57) ABSTRACT

The finger-mounted mechanical counter is a numerical counter that may be worn on the finger of a user. First, second and third wheels each have a set of indicia formed thereon, each set of indicia being a circumferentially arrayed set of integers, such as a continuous range from 0 to 9. The first, second and third wheels are rotatably mounted within a housing having corresponding first, second and third slots formed therein for display of the corresponding indicia. The housing defines a central passage which is adapted for receiving the finger of the user. After a full rotation of the first wheel, the second wheel is rotated by a single increment, and after full rotation of the second wheel, the third wheel is rotated by a single increment, allowing for consecutive counting from single digits to double digits to triple digits.

9 Claims, 8 Drawing Sheets

(56) References Cited

U.S. PATENT DOCUMENTS

| | | | | | |
|---|---|---|---|---|---|
| 2,540,808 | A * | 2/1951 | Bliss | G06M 1/041 377/92 |
| 2,989,230 | A | 6/1961 | Adams | |
| 3,337,129 | A * | 8/1967 | Johnson | G06M 1/02 235/133 R |
| 3,556,398 | A | 1/1971 | Walsh | |
| 5,088,072 | A | 2/1992 | Fitzmorris | |
| 5,181,009 | A | 1/1993 | Perona | |
| 6,547,434 | B1 | 4/2003 | DeRosa | |
| 2004/0129022 | A1 * | 7/2004 | Chien | A44C 25/001 63/1.11 |
| 2007/0157686 | A1 | 7/2007 | Chen et al. | |
| 2008/0041121 | A1 | 2/2008 | Chen et al. | |
| 2015/0342328 | A1 | 12/2015 | Seger | |

FOREIGN PATENT DOCUMENTS

| | | | | |
|---|---|---|---|---|
| DE | 1210218 | B * | 2/1966 | G06M 1/27 |
| EP | 0074797 | A1 * | 3/1983 | G06M 1/02 |
| GB | 1390349 | A * | 4/1975 | G06M 3/08 |
| WO | WO-2009144689 | A1 * | 12/2009 | G06M 1/00 |
| WO | WO-2017084475 | A1 * | 5/2017 | G06M 1/27 |

OTHER PUBLICATIONS

"How mechanical counters work"; printed on Jun. 4, 2021 from https://www.youtube.com/watch?v=rjWfliaOFR4.

* cited by examiner

FINGER-MOUNTED MECHANICAL COUNTER

CROSS-REFERENCE TO RELATED APPLICATION

This application claims the benefit of U.S. Provisional Patent Application No. 63/121,922, filed on Dec. 6, 2020.

BACKGROUND

1. Field

The disclosure of the present patent application relates to counting devices, and particularly to a finger-mounted mechanical counter providing a mechanical counter that is worn on the user's finger.

2. Description of the Related Art

Mechanical counting devices are used for a wide variety of purposes, such as for counting sales, counting laps run by a runner, counting repetitions of a particular exercise, etc. Such counters are typically handheld, with counting taking place through the depression of a button or the manual turning of dials. Typical counters mount the dials or the button in a barrel, or in a housing configured to be held within the palm of the hand, the dials or the button being thumb-actuated. Because the user must wrap his or her fingers around the barrel or housing to hold it securely within the palm, the ability to use that hand for other purposes becomes restricted. For an athlete or exerciser, for example, the ability to perform a particular activity or exercise while also using such a counter may become impossible. Thus, a finger-mounted mechanical counter solving the aforementioned problems is desired.

SUMMARY

The finger-mounted mechanical counter is a numerical counter that may be worn on the finger of a user. The finger-mounted mechanical counter includes an outer housing having opposed first and second ends, and an inner housing, also having opposed first and second ends. The outer housing has first, second and third slots formed therein. The inner housing is at least partially mounted within the outer housing, such that the respective first ends thereof align. The inner housing is a hollow shell defining a central passage adapted for receiving the user's finger. An annular space is defined between the inner housing and the outer housing. An annular wall extends between the first end of the outer housing and the first end of the inner housing. The annular wall defines an opening in open communication with the central passage of the inner housing.

A first annular wheel is rotatably mounted on and about the inner housing and is disposed within the annular space, such that the first annular wheel is aligned with the first slot formed in the outer housing. The first annular wheel has opposed annular front and rear faces. An annular gear is fixed to the rear face of the first annular wheel, the gear only having teeth over a 36° arc, the remainder of the gear being relatively smooth and continuous bottom land recessed from the edge of the first annular wheel.

A second annular wheel is also rotatably mounted on and about the inner housing and is disposed within the annular space, such that the second annular wheel is aligned with the second slot formed in the outer housing. The second annular wheel has opposed annular front and rear faces. An annular gear is fixed to the rear face of the second annular wheel, the gear only having teeth over a 36° arc, the remainder of the gear being relatively smooth and continuous bottom land recessed from the edge of the second annular wheel. The front face of the second annular wheel has a driven gear fixed thereto, the driven gear having teeth 360° about its circumference.

Similarly, a third annular wheel is also rotatably mounted on and about the inner housing and is also disposed within the annular space, such that the third annular wheel is aligned with the third slot formed in the outer housing. The third annular wheel has opposed annular front and rear faces, and the second annular wheel is positioned between the first and third annular wheels. The front face of the third annular wheel has a driven gear fixed thereto.

A dial is provided for rotation by the user to actuate counting by the finger-mounted mechanical counter. When worn on the user's finger, the dial may be rotated by the user's thumb. The dial has opposed front and rear ends, the first annular wheel being fastened to the rear end of the dial for rotation therewith.

Two pinion gears are rotatably mounted for independent rotation on a fixed shaft mounted in a lobular portion of the outer housing adjacent the three annular wheels. One pinion gear meshes with the driven gear on the front face of the second annular wheel and simultaneously rides along the bottom land or root circle of the gear attached to the rear face of the first annular wheel. The other pinion gear meshes with the driven gear on the front face of the third annular wheel and simultaneously rides along the bottom land or root circle of the gear attached to the rear face of the second annular wheel. Each of the first, second and third wheels may has indicia formed thereon, the indicia being the set of integers from one through nine arrayed about the circumference of each of the first, second and third wheels. When the count is incremented from "009" to "010", the first pinion gear drives the gear of the front face of the second annular wheel to rotate the second annular wheel one-tenth of a revolution, incrementing the tens digit by one. Similarly, when the count is incremented from "099" to "100", the second pinion gear drives the gear of the front face of the third annular wheel to rotate the third annular wheel one-tenth of a revolution, incrementing the hundreds digit by one. The process is repeated each time the ones digit or the tens digit transitions from "9" back to "0".

In use, rotation of the dial causes the first annular wheel to simultaneously rotate with the dial. The count is incremented, and carry-overs are incremented by the pinion gears incrementing the next succeeding number wheel by one digit so that the counter can display a count between "000" and "999".

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
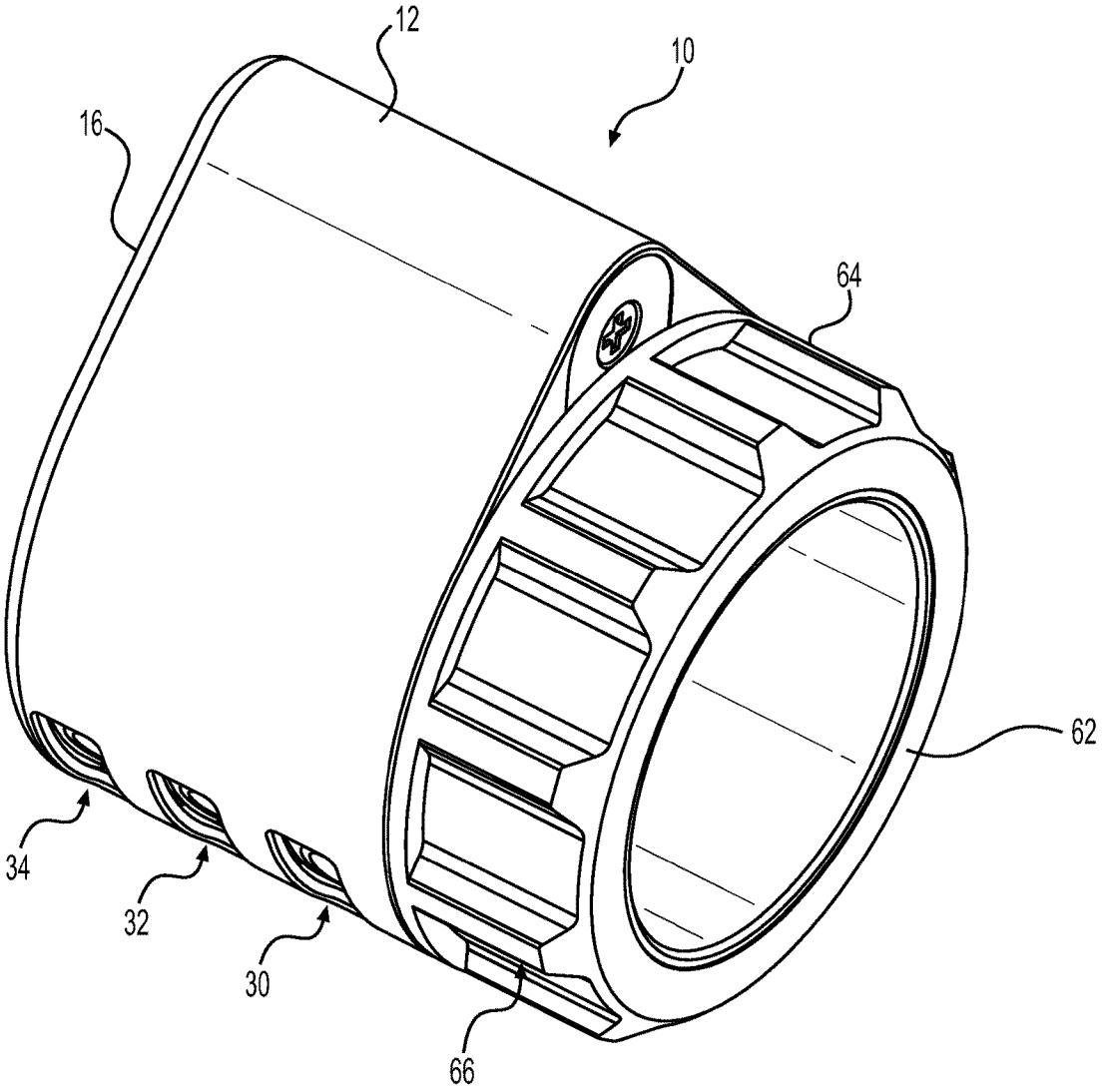
FIG. 1 is a perspective view of a finger-mounted mechanical counter.
Figure 2:
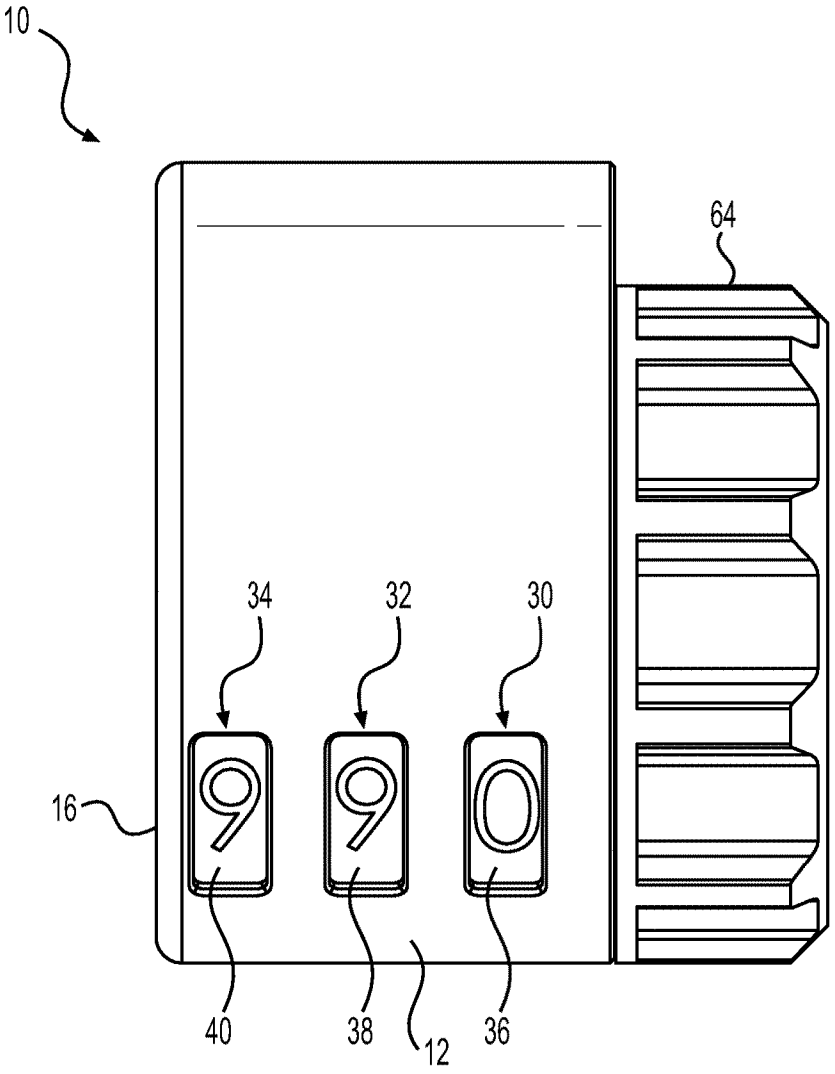
FIG. 2 is side view of the finger-mounted mechanical counter of FIG. 1.

The finger-mounted mechanical counter 10 is a numerical counter that may be worn on the finger of a user. As shown in FIGS. 1-5, the finger-mounted mechanical counter 10 includes an outer housing 12, having opposed first and second ends 16, 18, respectively, and an inner housing 14, also having opposed first and second ends 20, 21, respectively. The outer housing 12 has first, second and third slots 30, 32, 34, respectively, formed therethrough. It should be understood that the overall configuration and relative dimensions of the outer housing 12 are shown for exemplary purposes only, and may vary depending upon the desired size and shape of the finger-mounted mechanical counter 10, as well as its intended use and intended user.

Figure 3A:
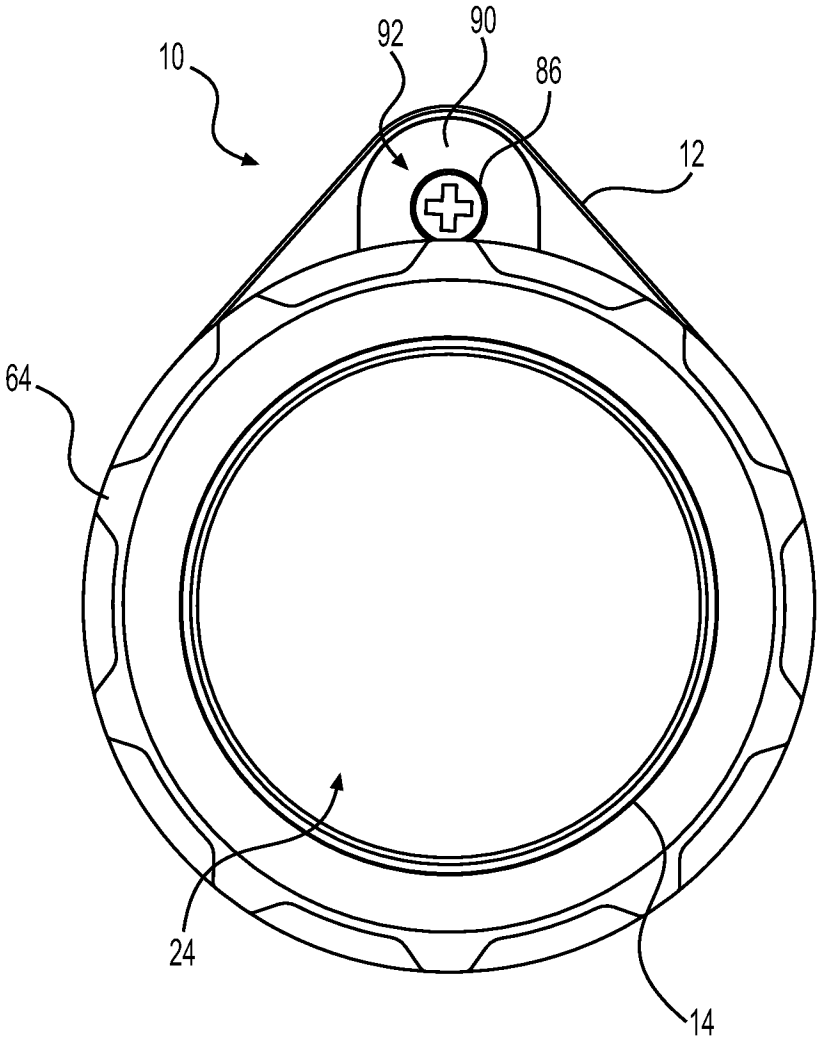
FIG. 3A is a front view of the finger-mounted mechanical counter of FIG. 1.
Figure 3B:
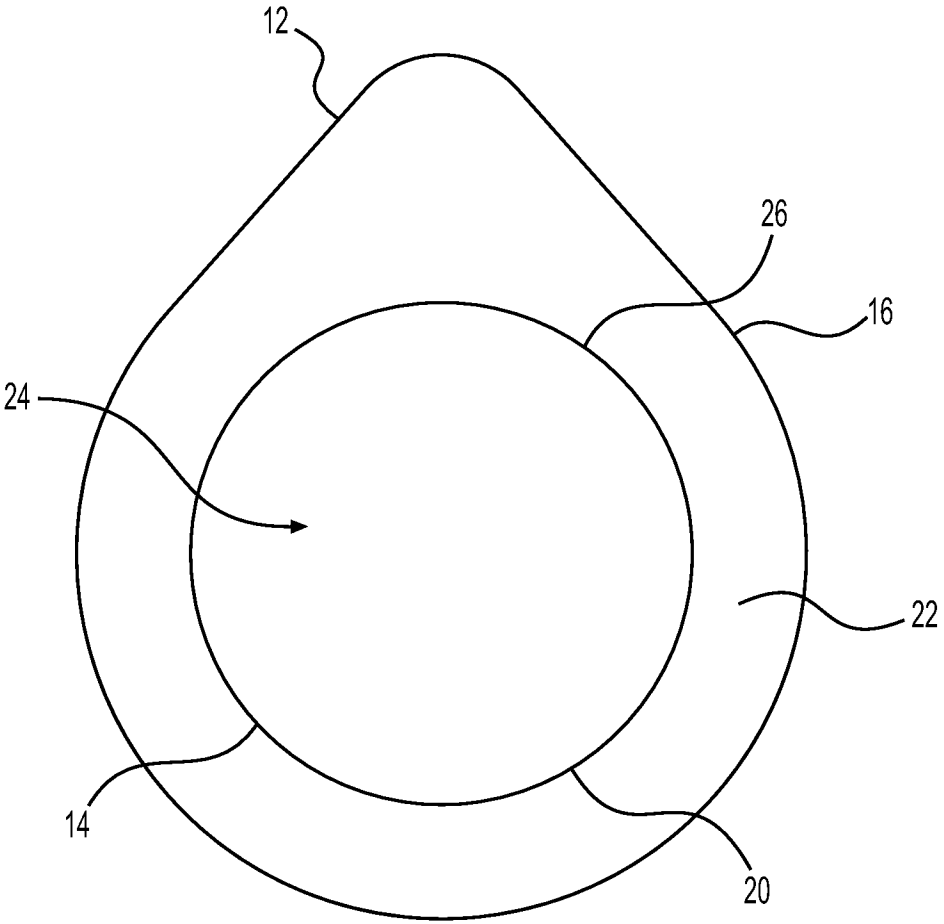
FIG. 3B is a rear view of the finger-mounted mechanical counter of FIG. 1.

The inner housing 14 is at least partially disposed within the outer housing 12, such that the respective first ends 16, 20 thereof align. The inner housing 14 defines a hollow cylindrical shell defining a central passage 24, such that the central passage 24 is adapted for receiving the user's finger. It should be understood that the inner housing 14 may have a wide variety of sizes, depending upon the particular finger the finger-mounted mechanical counter 10 is to be worn on, as well as variations in finger shapes and sizes of users. An annular space 28 is defined between the outer housing 12 and the inner housing 14. As best seen in FIG. 3B, an annular wall 22 extends between the first end 16 of the outer housing 12 and the first end 20 of the inner housing 14. The annular wall 22 defines an opening 26 in open communication with the central passage 24 of the inner housing 14. Thus, the rear face of the finger-mounted mechanical counter 10, shown in FIG. 3B, is closed, except for opening 26, which serves as an entry for the user's finger as the user's finger is placed within the central passage 24.

Figure 6:
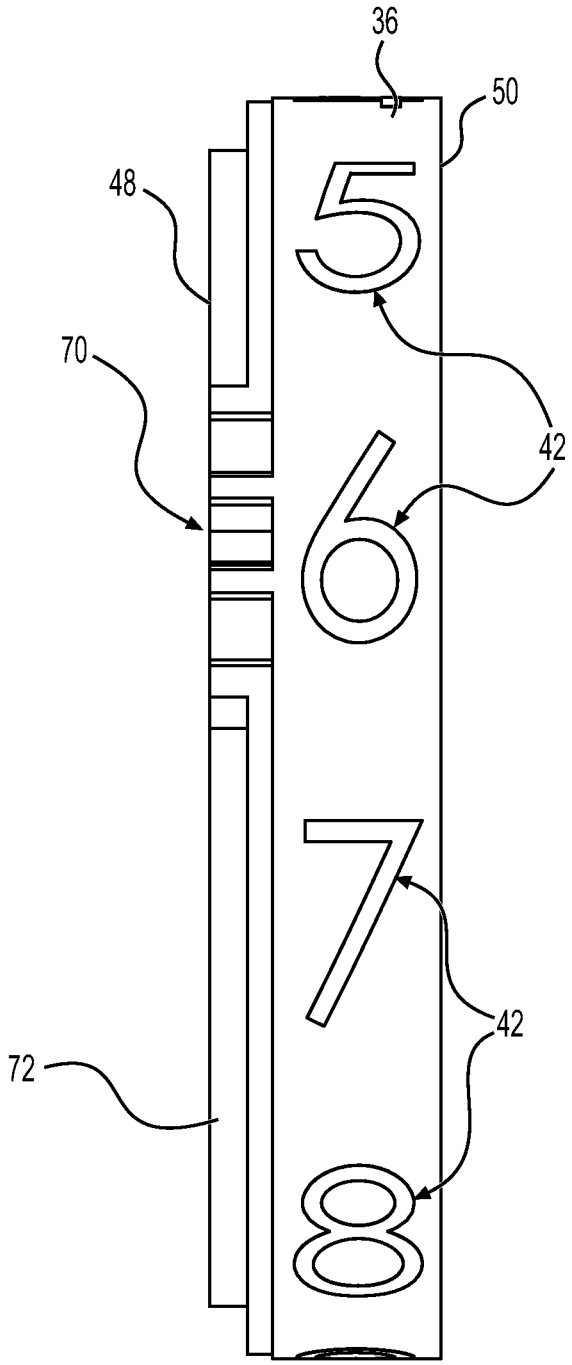
FIG. 6 is a side view of the first annular wheel of the finger-mounted mechanical counter of FIG. 1.

A first annular wheel 36 (or "ones" number wheel) is rotatably mounted on and about the inner housing 14 and is disposed within the annular space 28, such that the first annular wheel 36 is aligned with the first slot 30 formed in the outer housing 12. The first annular wheel 36 has opposed annular rear and front faces 48, 50, respectively. As best shown in FIG. 6, the rear face 48 of the first annular wheel 36 has a thin (about 1.5 mm) annular gear 72 fixed thereto, the gear 72 only having teeth 70 defined over a 36° arc (about one-tenth the circumference of the annular wheel 36), the height of the teeth 70 extending up to but not beyond the perimeter of the wheel 36, the bottom land or root circle of the remaining 324° of the gear 72 being recessed from the circumference or perimeter of the wheel 36 by the height of the teeth 70.

Figure 7:
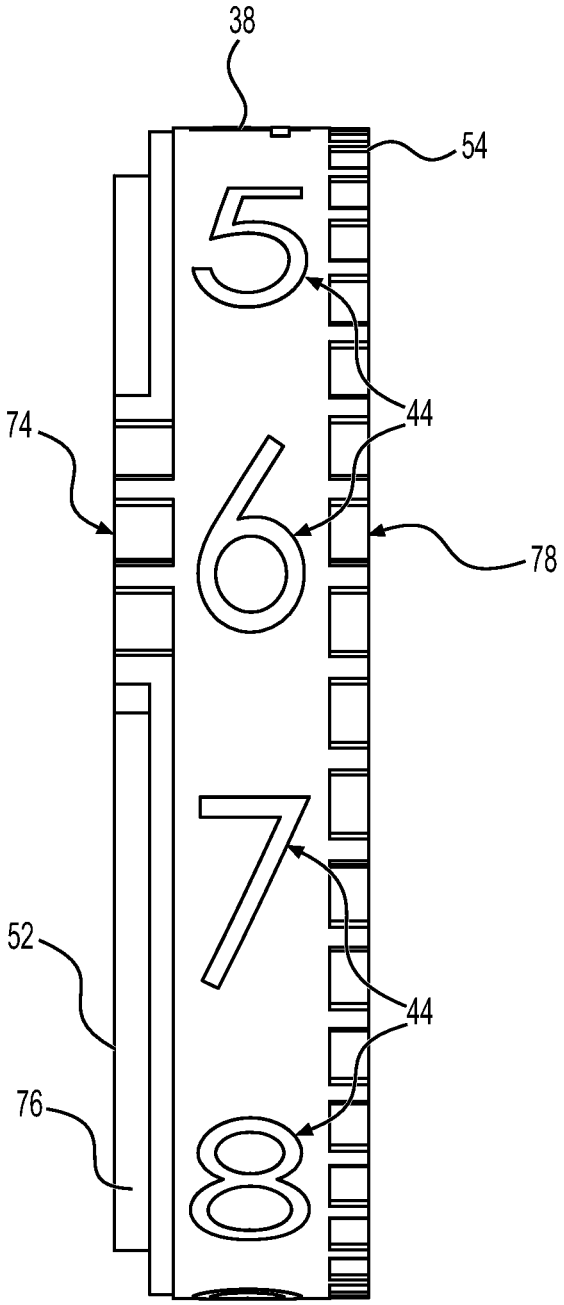
FIG. 7 is a side view of the second annular wheel of the finger-mounted mechanical counter of FIG. 1.

A second annular wheel 38 (or "tens" number wheel) is also rotatably mounted on and about the inner housing 14 and is disposed within the annular space 28, such that the second annular wheel 38 is aligned with the second slot 32 formed in the outer housing 12. The second annular wheel 38 has opposed annular rear and front faces 52, 54, respectively. As best shown in FIG. 7, the rear face 52 of the second annular wheel 38 has a thin (about 1.5 mm) annular gear 76 fixed thereto, the gear 76 only having teeth 74 defined over a 36° arc (about one-tenth the circumference of the annular wheel 38), the height of the teeth 74 extending up to but not beyond the perimeter of the wheel 38, the bottom land or root circle of the remaining 324° of the gear 76 being recessed from the circumference or perimeter of the wheel 38 by the height of the teeth 74. The front face 54 of the second annular wheel 38 has a driven gear 78 fixed thereto, the driven gear having teeth extending 360° about its circumference, the teeth of the driven gear 78 extending up to but not beyond the perimeter of the wheel 38.

Similarly, a third annular wheel 40 (or "hundreds" number wheel) is also rotatably mounted on and about the inner housing 14 and is also disposed within the annular space 28, such that the third annular wheel 40 is aligned with the third slot 34 formed in the outer housing 12. The third annular wheel 40 has opposed annular rear and front faces 56, 58, respectively, and the second annular wheel 38 is positioned between the first and third annular wheels 36, 40, respectively. The rear face of the third annular wheel 40 does not have a gear attached thereto. The front face 58 of the third annular wheel 40 has a driven gear 80 fixed thereto, the driven gear having teeth extending 360° about its circumference, the teeth of the driven gear 80 extending up to but not beyond the perimeter of the wheel 40. It should be understood that the relative dimensions of first, second and third annular wheels 36, 38, 40, respectively, are shown for exemplary purposes only.

Figure 4:
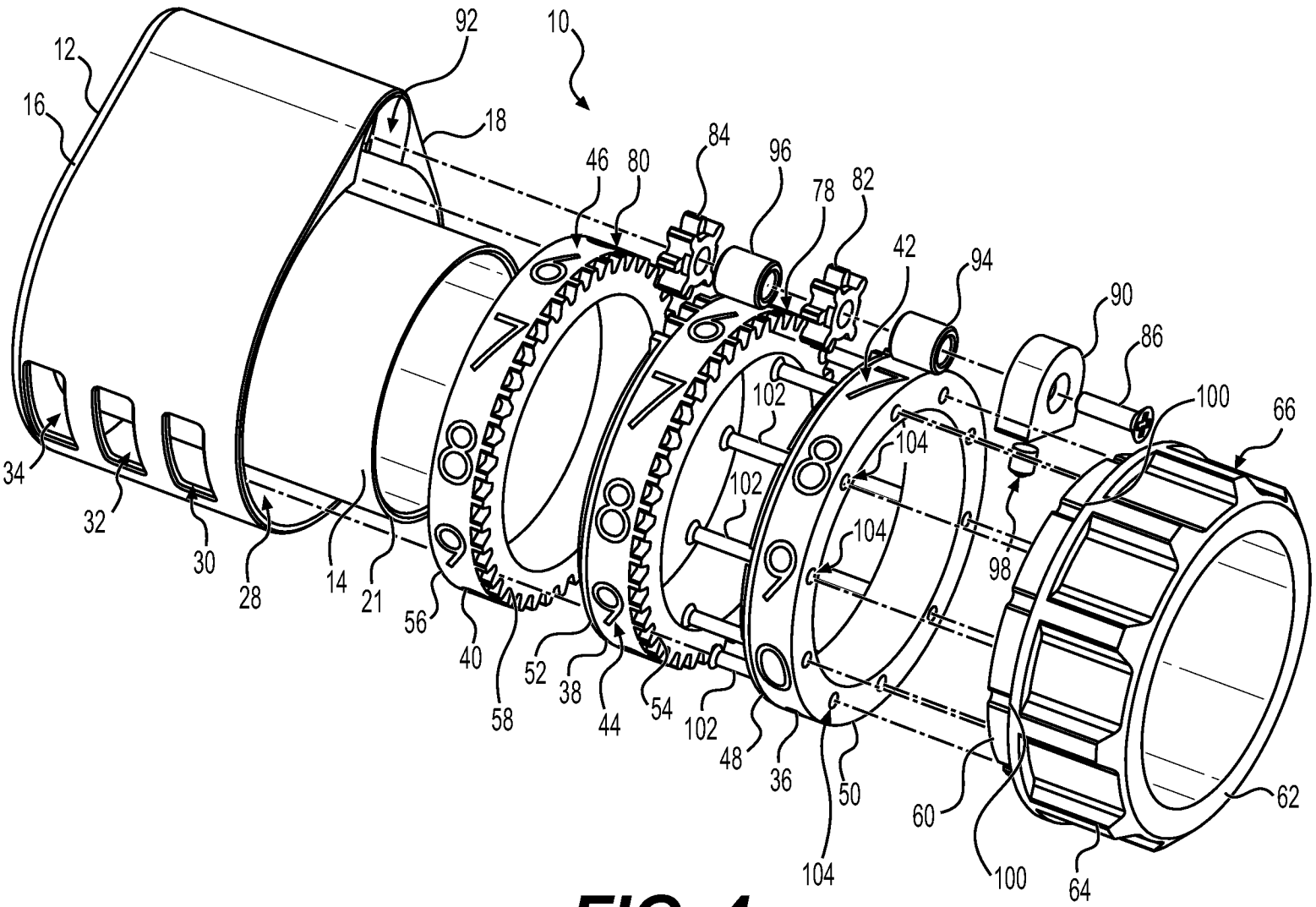
FIG. 4 is an exploded perspective view of the finger-mounted mechanical counter of FIG. 1.
Figure 5:
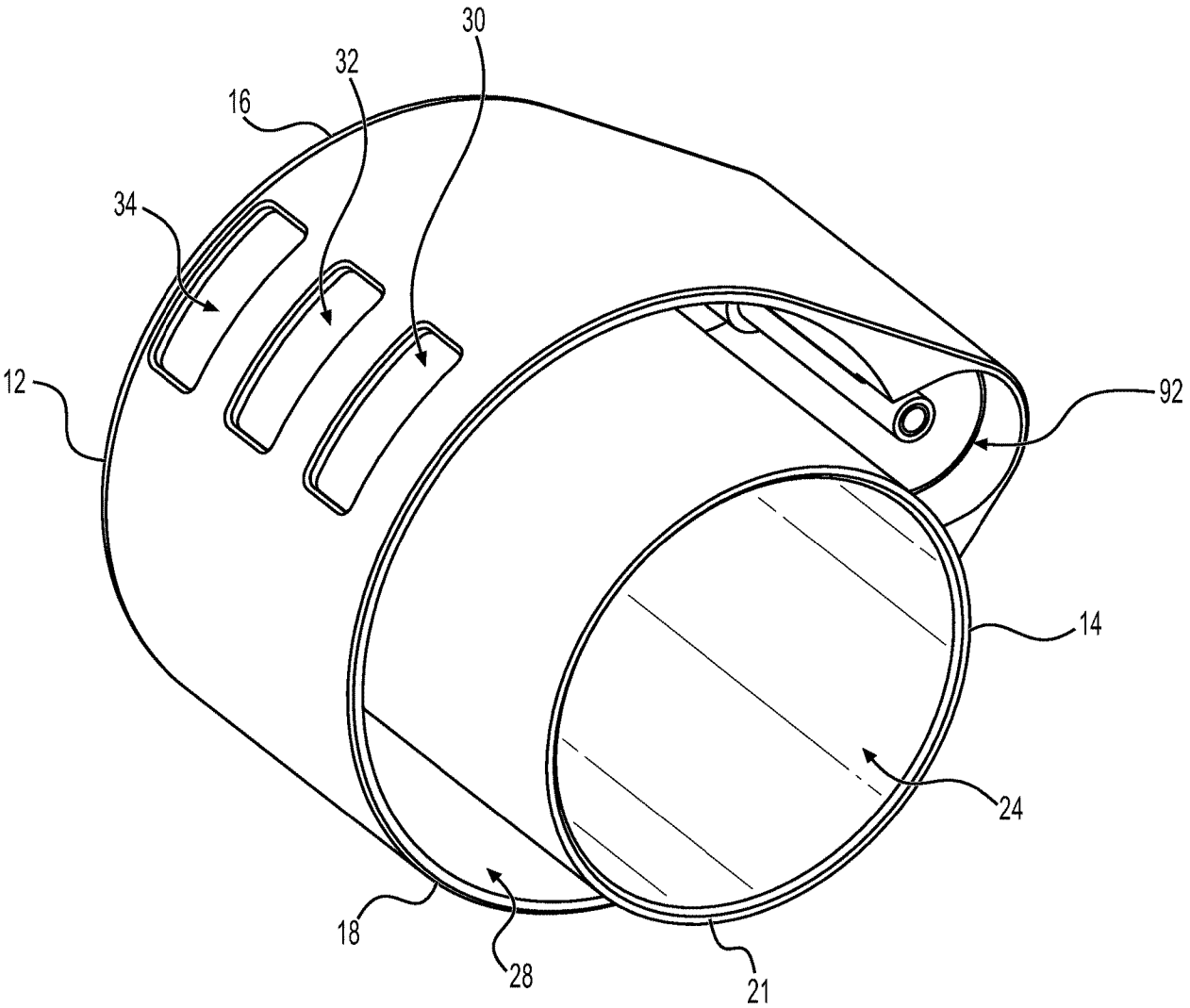
FIG. 5 is a perspective view of the outer and inner housings of the finger-mounted mechanical counter of FIG. 1.

A dial 64 is provided for rotation by the user to actuate counting by the finger-mounted mechanical counter 10. When worn on the user's finger, the dial 64 may be rotated by the user's thumb. The dial 64 has opposed rear and front ends 60, 62, respectively. The first annular wheel 36 is attached to the rear end 60 of the dial 64 for rotation with the dial 64. Thus, rotation of the dial 64 drives simultaneous rotation of the first annular wheel 36. It should be understood that the gripping surface 66 of dial 64 is shown for exemplary purposes only, and that any suitable type of grip, texturing or the like may be utilized. In FIG. 4, fasteners 102 are shown passing through corresponding passages 104 axially formed through the first annular wheel 36 for connection to rear face 60 of the dial 64. It should be understood that the fasteners 102 are shown for exemplary purposes only, and that the first annular wheel 36 may be fixed to the rear face 60 of the dial 64 by any suitable type of screw, bolt, adhesive, or other fasteners or fastening means that would cause rotation of the dial 64 to simultaneously drive rotation of the first annular wheel 36.

Pinion gears 82, 84, respectively, are mounted for independent rotation on a fixed shaft 86. The shaft 86 does not rotate. Rather, each of the pinion gears 82, 84 rotates on the shaft 86. Each of the first, second and third wheels 36, 38, 40, respectively, has corresponding indicia 42, 44, 46 formed thereon. The indicia 42, 44, 46 are the set of integers between "0" and "9" arrayed about the circumference of each of the first, second and third wheels 36, 38, 40, respectively. The first number wheel 36 is capable of displaying a count between "000" and "009", the first and second number wheels 36, 38 are capable of displaying a count between "010" and "099", and the three number wheels 35, 38, and 40 are capable of displaying a count between "100" and "999" as the dial 64 is rotated. The teeth of pinion gear 82 engage the driven gear 78 attached to the front face 54 of the second number wheel 38 and simultaneously bear against the bottom land or root circle of the gear 72 attached to the rear face 48 of the first number wheel 36. The number wheels 36, 38 are aligned so that the pinion gear 82 does not rotate as the dial 64 is rotated to increment the count from "000" through "009", the gear 72 not having any teeth over that 324° arc. However, when the dial 64 is rotated to increment the count above "009", the teeth 70 of the gear 72 drive the pinion gear 82 to rotate, which rotates the driven gear 78 to rotate through a 36° arc, or one-tenth of a revolution of the second number wheel 38 to advance the display or count to "010". The pinion gear 82 does not rotate again until the count is advanced from "019" to "020", the teeth of the pinion gear 82 again riding along the portion of the bottom land of the gear 72 until the teeth 70 of the gear 72 engage the pinion gear 82 again.

Similarly, the teeth of pinion gear 84 engage the driven gear 80 attached to the front face 58 of the third number wheel 40 and simultaneously bear against the bottom land or root circle of the gear 76 attached to the rear face 52 of the second number wheel 38. The number wheels 38, 40 are aligned so that the pinion gear 84 does not rotate as the dial 64 is rotated to increment the count from "010" through "099", the gear 76 not having any teeth over that 324° arc. However, when the dial 64 is rotated to increment the count above "099", the teeth 74 of the gear 76 drive the pinion gear 84 to rotate, which rotates the driven gear 80 to rotate through a 36° arc, or one-tenth of a revolution of the third number wheel 40 to advance the display or count to "100". The pinion gear 84 does not rotate again until the count is advanced from "199" to "200", the teeth of the pinion gear 84 again riding along the portion of the bottom land of the gear 76 until the teeth 74 of the gear 76 engage the pinion gear 84 again.

As shown in FIG. 4, a lobe 90 may be provided for at least partially supporting the shaft 86. The lobe 90 is disposed within a portion 92 of the annular space 28. Additionally, first and second spacers 94, 96, respectively, may be mounted on the shaft 86. The first spacer 94 is positioned between the lobe 90 and the pinion gear 82, and the second spacer 96 is positioned between the two pinion gears 82, 84, respectively. Further, in order to provide resistance to the dial 64, a spring detent ball plunger 98, detent pin, or the like may be installed in the lobe 90 for releasably engaging detents 100 formed in the dial 64, as shown in FIG. 4, preventing accidental slippage of the dial 64 as the count is incremented.

It should be understood that the three annular wheels 36, 38, 40 are shown for exemplary purposes only, and that any suitable number of wheels (and corresponding number of slots formed through outer housing 12) may be used, the incremental counting being carried out in a similar manner to that of the three annular wheels 36, 38, 40 described above. Further, it should be understood that the indicia 42, 44, 46 are shown for exemplary purposes only, and that any style, font, size and type of numeral or other symbol may be used. Similarly, it should be understood that the overall configuration and relative dimensions of the slots 30, 32, 34 are shown for exemplary purposes only and may be varied. For example, the slots 30, 32, 34 may be circular or oval shaped.

It is to be understood that the finger-mounted mechanical counter is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A finger-mounted mechanical counter, comprising:

an outer housing having opposed first and second ends, the outer housing having first, second and third slots formed therein and a lobular portion extending between the first and second ends;

an inner housing having opposed first and second ends, wherein the inner housing at least partially received within the outer housing such that the respective first ends of the outer and inner housings are aligned, the inner housing being a hollow and cylindrical, defining a central passage adapted for receiving a finger of the user, an annular space being defined between the inner housing and the outer housing;

an annular wall extending between the first end of the outer housing and the first end of the inner housing, the annular wall defining an opening in open communication with the central passage of the inner housing;

a first annular wheel rotatably mounted on and about the inner housing, the first annular wheel being disposed within the annular space and aligned with the first slot in the outer housing, the first annular wheel having opposed annular front faces, the rear face of the first annular wheel having an annular gear fixed thereto for rotation with the first annular wheel, the gear having teeth only over an arc of 36°, the gear having a root circle extending over the remaining 324° recessed from an outer edge of the first annular wheel by a distance equal to height of the gear teeth;

a second annular wheel rotatably mounted on and about the inner housing, the second annular wheel being disposed within the annular space and aligned with the second slot formed in the outer housing, the second annular wheel having opposed annular front and rear faces, the rear face of the second annular wheel having an annular gear fixed thereto for rotation with the second annular wheel, the gear having teeth only over an arc of 36°, the gear having a root circle extending over the remaining 324° recessed from an outer edge of the second annular wheel by a distance equal to height of the gear teeth, the front face of the second annular wheel having a driven gear affixed thereto;

a third annular wheel rotatably mounted on and about the inner housing, the third annular wheel being disposed within the annular space and aligned with the third slot formed in the outer housing, the second annular wheel being positioned between the first and third annular wheels, the third annular wheel having opposed annular front and rear faces, the front face of the third annular wheel having a driven gear affixed thereto;

a dial having opposed front and rear ends, the first annular wheel being fastened to the rear end of the dial for rotation therewith;

a shaft mounted in the annular space in the lobular portion of the outer housing adjacent the first, second and third annular wheels;

a first pinion gear rotatably mounted on the shaft, the first pinion gear meshing with the driven gear fixed to the front face of the second annular wheel throughout each complete revolution of the first annular wheel and meshing with the teeth of the gear affixed to the rear face of the first annular wheel for one-tenth of each revolution of the first annular wheel, the first pinion gear being an intermediate gear driving revolution of the second annular wheel to increment a count by one for every tenth count of the first annular wheel; and a second pinion gear rotatably mounted on the shaft, the second pinion gear meshing with the driven gear fixed to the front face of the third annular wheel throughout each complete revolution of the second annular wheel and meshing with the teeth of the gear affixed to the rear face of the second annular wheel for one-tenth of each revolution of the second annular wheel, the second pinion gear being an intermediate gear driving revolution of the third annular wheel to increment a count by one for every tenth count of the second annular wheel.

2. The finger-mounted mechanical counter as recited in claim 1, wherein each of the first, second and third wheels has indicia formed thereon, the indicia being a set of integers arrayed about a circumference of each of the first, second and third wheels.

3. The finger-mounted mechanical counter as recited in claim 2, wherein the set of integers is between 0 and 9.

4. The finger-mounted mechanical counter according to claim 1, where said shaft is rigidly mounted between said inner housing and said outer housing, said first and second pinion gears being independently rotatable on said shaft.

5. The finger-mounted mechanical counter according to claim 1, further comprising a lobe-shaped mount securing said shaft between said inner housing and said outer housing.

6. The finger-mounted mechanical counter as recited in claim 5, further comprising a first spacer disposed on said shaft between said lobe-shaped mount and said first pinion gear.

7. The finger-mounted mechanical counter as recited in claim 5, further comprising a second spacer disposed on said shaft between said first pinion gear and said second pinion gear.

8. The finger-mounted mechanical counter as recited in claim 5, wherein said dial has a plurality of radially extending detent recesses defined therein, the mechanical counter further comprising a spring-biased ball plunger mounted in said lobe-shaped mount selectively engaging the detent recesses when said dial is rotated to prevent slippage of the dial during a count.

9. The finger-mounted mechanical counter as recited in claim 5, wherein said dial has a plurality of radially extending detent recesses defined therein, the mechanical counter further comprising a spring-biased detent pin mounted in said lobe-shaped mount selectively engaging the detent recesses when said dial is rotated to prevent slippage of the dial during a count.

* * * * *